US005205302A

United States Patent [19]

Lemon et al.

[11] Patent Number: 5,205,302

[45] Date of Patent: Apr. 27, 1993

[54] SOFT BRUSH GUM STIMULATOR

[75] Inventors: J. Robert Lemon, Charlotte; William T. Evans; Robert E. Christian, both of Batesville, all of Ark.

[73] Assignee: Professional Dental Technologies, Inc., Batesville, Ark.

[21] Appl. No.: 854,329

[22] Filed: Mar. 19, 1992

Related U.S. Application Data

[62] Division of Ser. No. 585,479, Sep. 19, 1990, Pat. No. 5,109,563.

[51] Int. Cl.[5] ..... A61C 15/00; A61H 7/00; A46B 9/04

[52] U.S. Cl. ..... 132/321; 15/167.1; 128/62 A

[58] Field of Search ..... 433/141; 128/62 A; 132/321, 328, 329; 15/167.1, 110

[56] References Cited

U.S. PATENT DOCUMENTS

| | | | |
|---|---|---|---|
| 1,736,525 | 11/1929 | Evslin | 15/167.1 |
| 1,874,467 | 8/1932 | Doll | 15/110 |
| 2,016,597 | 10/1935 | Drake | 15/110 X |
| 2,656,559 | 10/1953 | Wisenan | 15/167.1 X |
| 2,736,917 | 3/1956 | Goldstein et al. | 15/167.1 X |
| 2,800,899 | 7/1957 | Barron | 128/62 A |
| 2,819,482 | 1/1958 | Applegate | 15/110 |
| 2,888,008 | 5/1959 | Rosenthal | 128/62 A |
| 4,296,518 | 10/1981 | Furrier et al. | 128/62 A |
| 4,679,272 | 7/1987 | Florence | 15/110 X |
| 4,869,277 | 9/1989 | Olsen | 15/167.1 |
| 4,879,781 | 11/1989 | Desimone | 15/110 |

FOREIGN PATENT DOCUMENTS

| | | | |
|---|---|---|---|
| 18670 | 11/1889 | United Kingdom | 132/328 |

*Primary Examiner*—Robert P. Swiatek
*Assistant Examiner*—Nicholas D. Lucchesi
*Attorney, Agent, or Firm*—McAulay Fisher Nissen Goldberg & Kiel

[57] ABSTRACT

A gum stimulator is disclosed which has a removable brush composed of a high-density of soft thin fibers. The brush tip is disposed on a handle, which may comprise an end of a toothbrush, and is mounted on a shaft which extends from the handle. In one embodiment, the brush extends at an angle of about 90 degrees from the handle and includes long fibers surrounded by short fibers which penetrate the interstitial spaces between the teeth to provide complete gum stimulation without casuing tissue damage.

6 Claims, 2 Drawing Sheets

SOFT BRUSH GUM STIMULATOR

This is a division of application Ser. No. 07/585,479, filed Sep. 19, 1990 now U.S. Pat. No. 5,109,563.

TECHNICAL FIELD

This invention relates to gum stimulators and more particularly to a gum stimulator using a soft brush having a high density of thin fibers.

BACKGROUND

Various gum stimulators are known in the art for promoting dental health. These typically comprised soft rubber conically shaped tips, such as those usually found on a toothbrush at an end opposite the brushing end. In some instances, the soft rubber tip stimulators have been mounted on their own handle devices rather than being incorporated with a toothbrush.

Such soft rubber gum stimulators are generally limited in their ability to stimulate gum tissue between teeth due to the inability to penetrate the interstitial spaces between the teeth. Also, such tips have limited flexibility as flexibility decreases as the thickness of the tip increases.

In U.S. Pat. No. 4,911,187 to Castillo, a dental pick brush apparatus is disclosed, having a brush with radially outwardly extending bristles which extend from a bristle pin, with some bristles extending forwardly and others outwardly. A pick extends through the fiber bristles. The apparatus is designed to be used only once and disposed of.

Such a dental pickbrush combination has limited application as a gum stimulator as the insertion depth of the brush is limited by the thickness of the pick. Since the brush is primarily designed for cleaning teeth, the radial bristles have a limited ability to stimulate the gums.

In U.S. Pat. No. 4,690,277 to Lewis, Jr., a plurality of prepackaged, fused synthetic tooth brushes is disclosed. In one figure, a toothbrush is shown having a single hollow fused circular tuft at one end. However, the brush is permanently mounted to the handle, and being composed of the same fibers as the toothbrush, is neither soft nor of high density. Such a brush is believed to have minimal value as a gum stimulator.

SUMMARY OF THE INVENTION

It is an object of the present invention to provide a gum stimulator which uses a soft brush having a high density of thin fibers.

It is a further object to provide a gum stimulator having a handle portion to which the brush may be removably attached.

It is another object to provide a gum stimulator which uses a brush having a plurality of parallel fibers extending angularly from the handle, the center fibers being longer than the adjacent fibers to assure sufficient fiber penetration in the interstitial spaces between the teeth to stimulate the gum tissue therein.

These and other objects of the present invention are achieved by providing a gum stimulator having a handle, a removable brush having a plurality of thin soft fibers extending from the handle, and means for attaching the brush removably to the handle. The brush includes a high density of thin soft fibers extending from a bottom plate formed from melted fibers. Utilizing such a construction has been found to prevent the fibers from separating during use. The brush has means for mounting removably to the handle so that the brush can be replaced after use. In another embodiment of the invention, the handle is a toothbrush having means for mounting the high fiber density soft brush on an end opposite the tooth brushing end.

DETAILED DESCRIPTION OF THE INVENTION

Figure 1:
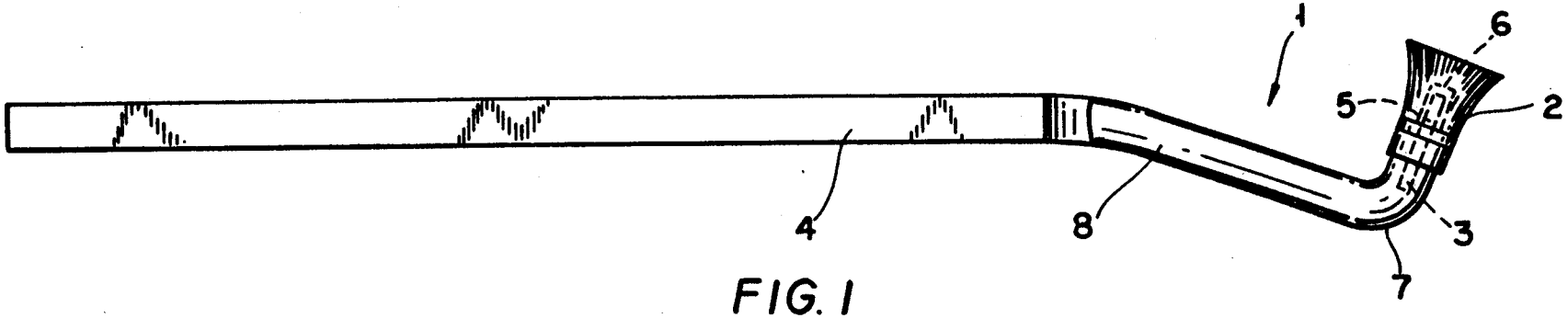
FIG. 1 is an illustrative view of the gum stimulator of the present invention.

Referring to FIG. 1, a gum stimulator 1 includes a brush 2 mounted on a shaft 3 extending from a handle 4, the shaft 3 being partially embedded in the handle 4. The shaft has a shaped end 5 which mates with a shaped receptacle 6 on the end of the brush 2. Preferably, the shaped end 5 is slightly larger than the receptacle to provide an interference fit, allowing the brush to be removed by sliding it off the shaft.

The brush 2 is composed of a plurality of soft parallel fibers made from a material such as nylon. The fibers are very thin. For example, a nylon material with the designation Dupont Code 0900 MA can be used and may be formed into a brush according to the method and apparatus disclosed in U.S. Pat. No. 4,689,277 to Hans Olson, commonly assigned herewith, the disclosure of which is hereby incorporated by reference. Various brush head configurations may also be used, such as those shown in U.S. Pat. No. D295,801, commonly assigned herewith and hereby incorporated by reference. Such brushes have a bottom plate formed of meltedwelded fibers, to assure that all the fibers are firmly attached to the bottom plate. The brush must be composed of soft fibers to prevent tissue damage and be provided in a high density, i.e. 1,000 to 5,000 fibers per brush.

The handle 4 is preferably composed of a hard plastic such as polypropyene, polyester, polystyrene or polyamide. The shape of the handle may vary considerably, being round, oval, planar, rectangular or another shape. Whatever shape is used, it should be convenient for grasping and for allowing access of the brush to massage the gums adjacent the back teeth. Referring again to FIG. 1, the handle 4 has a first angle section 7 and a second angle section 8 which assist in accessing the brush to the gum tissue along the back teeth.

The shaft 3 for mounting the brush to the handle preferably is partially embedded in the plastic handle. The shaft should be of metal to avoid breakage but could also be made of a strong plastic. Preferably the shaped end 5 has a knurled surface for mating with a multi-sided receptacle in the brush, for example, as shown in the '277 patent. Of course other mating structures could also be used. For example, the brush could have a co-molded extension, or integral tail, which is accepted in a socket in the handle. Thus, no shaft would be needed.

Figure 2:
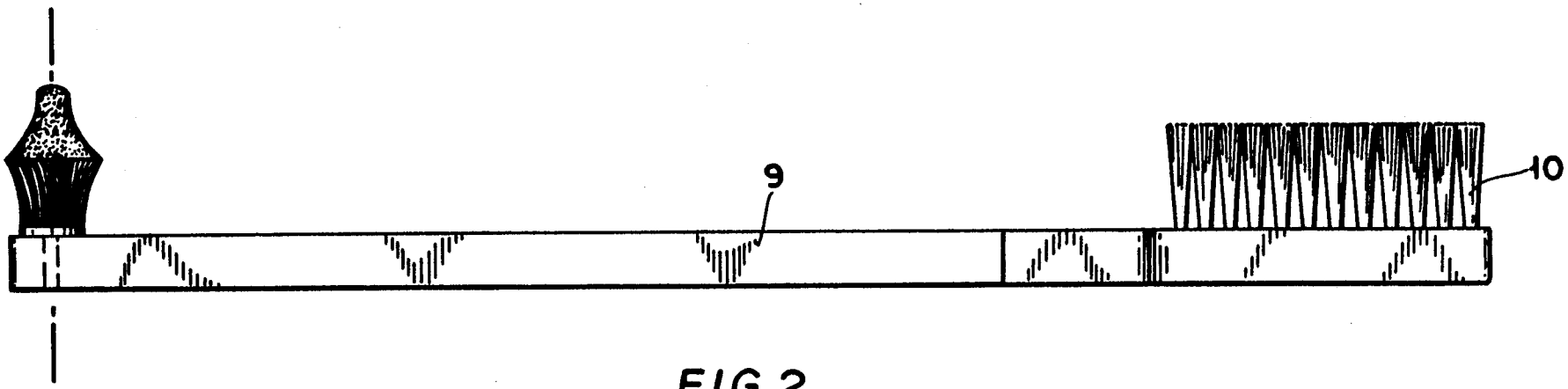
FIG. 2 is an alternative embodiment of the gum stimulator of the present invention, combined with a toothbrush.

Referring to FIG. 2, another embodiment of the present invention is shown. A handle 9 is part of a toothbrush of conventional construction, having a toothbrush end 10. The handle 9 has an end 11 opposite to the toothbrush 10 which includes an embedded shaft 12, similar to the above described means for mounting the brush head to the handle. A brush 13 is removably mounted to the shaft 12, and has elongated center fibers 14 for penetrating the interstitial spaces between adjacent teeth.

Figure 3:
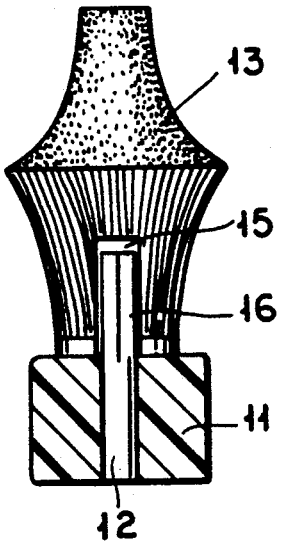
FIG. 3 is a view taken along line 3—3 of FIG. 2.

Referring to FIG. 3, the brush and handle are shown in cross section. The brush 13 has a shaped receptacle 15 which accepts a shaped end 16 of the shaft 12 therein.

Figure 4:
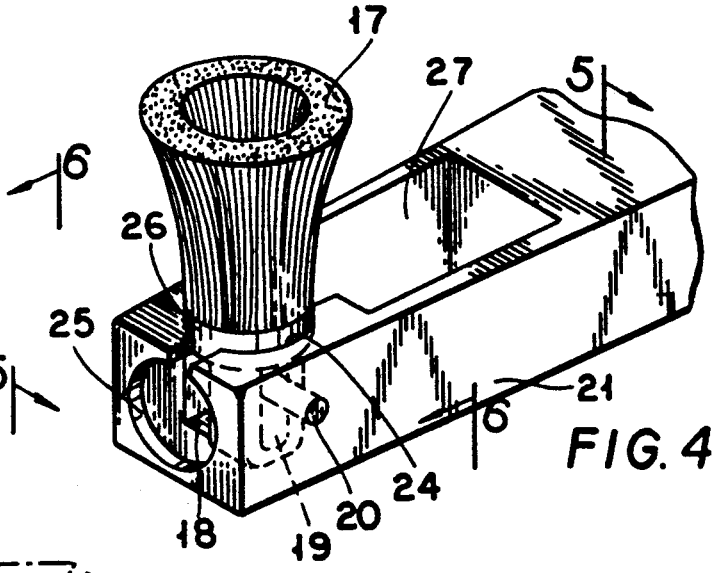
FIG. 4 is another alternative embodiment of the gum stimulator of the present invention.

In yet another embodiment of the present invention, shown in FIG. 4, a brush 17 is mounted on a mounting block 18 having opposing slots 19. A pivot rod 20 is disposed within a handle 21, with the pivot rod passing through the opposing slots. The handle also includes a bottom socket 22 for accepting an end 23 of the mounting block therein. Two brush supporting openings, 24 and 25, are also provided which accept a bottom plate 26 of the brush therein. The openings allow locking the brush in either the 90° or 180° orientation. When the mounting block end is free of the socket 22, the shaft and brush are movable in an arc about the pivot rod. The handle 21 also has a brush receptacle 27 shaped to accept the brush therein for storage. Thus the brush would lock in at two positions, at 90 degrees to the handle, and at 180 degrees to the handle, and is freely rotatable into and out of the rest position in the brush receptacle.

Figure 5:
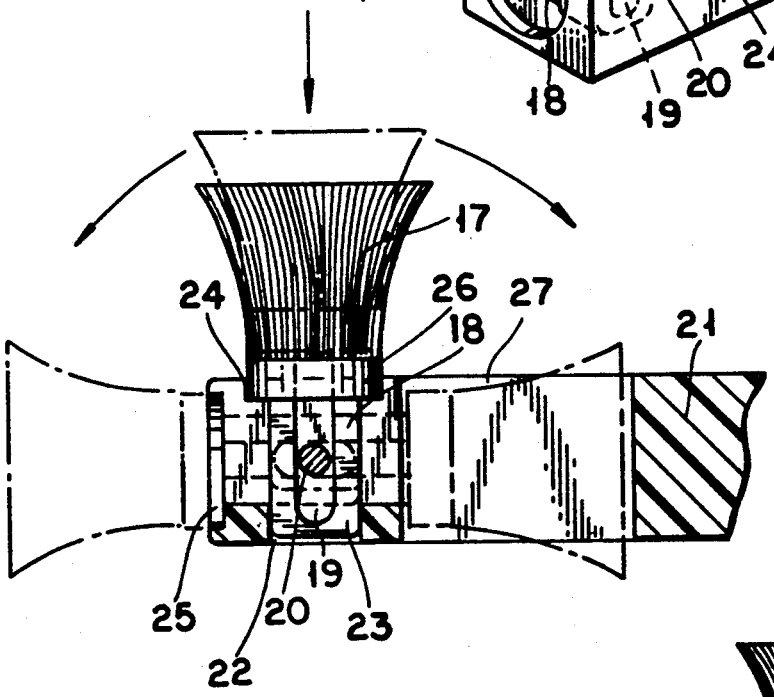
FIG. 5 is a view taken along line 5—5 of FIG. 4.
Figure 6:
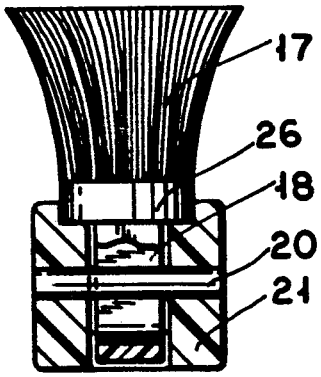
FIG. 6 is a view taken along line 6—6 of FIG. 4.

Referring to FIG. 5, the brush is shown in the 90° position, locked in place with the bottom plate 26 in the opening 24. To unlock the brush, it would be pulled upward to free the bottom plate from the opening and the mounting block end 23 free of the bottom socket 22 as shown in phantom. The brush would then be free to move in the prescribed arc. The brush is also shown in phantom in the 180° position, and at rest.

Utilizing a removable brush allows changing the types of brush to optimize gum stimulation, while also allowing disposal of the brush after use. By providing a brush with soft fibers in a high density (1,000 to 5,000 fibers per tip), substantial gum stimulation is achieved without danger of gum damage. The thinness of the fiber also assures penetration of the fibers in the interstitial spaces between the teeth to stimulate the gums in what was previously considered an inaccessible area.

The brush usable with the present invention may have different shapes to effect different types of gum stimulation and in particular, the brush may have a flat end as shown in FIG. 1, a cup end as shown in FIG. 4 or, a plurality of long fibers surrounded by short fibers as shown in FIG. 3, etc. The type will depend on individual need and preference. However, in all cases, the brush must be composed of soft fiber to prevent damage to the gum tissue, and have a high density, i.e. 1,000 to 5,000 fibers per brush. The brush diameter may vary from 0.12–0.5 inch in diameter, as measured at the bottom plate.

While particular embodiments have been shown and described, it will be understood by those skilled in the art that various modifications and changes could be made without varying from the scope of the present invention.

What is claimed is:

1. A gum stimulator and toothbrush comprising a handle, a removable non-rotational brush disposed on the handle, the brush having a thin flat bottom plate and having a high density of soft fibers for gum stimulation, extending upwardly from the bottom plate and being unsupported around the sides thereof, and means for attaching the brush to the handle, the attachment means comprising an immovable shaft permanently embedded in either one of the handle or brush and a shaped mating receptacle formed in the other of the brush or handle for accepting the shaft therein with a socket fit, the handle having an end including a plurality of brush tufts extending upwardly therefrom to form a toothbrush, the handle having a planar gripping portion adjacence the toothbrush end, and the gum stimulating brush disposed at the end of the griping portion opposite the toothbrush end.

2. The gum stimulator of claim 1 wherein the brush has from 1,000 to 5,000 fibers.

3. The gum stimulator of claim 1 wherein the fibers are composed of nylon.

4. The gum stimulator of claim 1 wherein the brush has elongated central fibers surrounded by smaller fibers.

5. The gum stimulator of claim 1 wherein the brush has a flat shape.

6. The gum stimulator of claim 1 wherein the brush has a cupped shape.

* * * * *